US005878948A

United States Patent [19]

Schultz et al.

[11] Patent Number: 5,878,948

[45] Date of Patent: Mar. 9, 1999

[54] MANUAL ASSEMBLY FOLDING BOX WITH TAMPERPROOF CLOSURE

[75] Inventors: Günther Schultz, Hamburg; Klaus-Peter Stange, Wentorf, both of Germany

[73] Assignee: Beiersdorf AG, Hamburg, Germany

[21] Appl. No.: 925,955

[22] Filed: Sep. 9, 1997

[30] Foreign Application Priority Data

Sep. 12, 1996 [DE] Germany ..... 196 37 022.1

[51] Int. Cl.[6] ..... B65D 5/00

[52] U.S. Cl. ..... 229/148; 229/117.14; 229/154

[58] Field of Search ..... 229/148, 117.09, 229/117.12, 117.14, 117.13; 206/154, 175

[56] References Cited

U.S. PATENT DOCUMENTS

| | | | |
|---|---|---|---|
| 1,522,311 | 1/1925 | MacLellan | 229/117.14 X |
| 1,915,658 | 6/1933 | Gagen | 229/117.14 X |
| 2,523,986 | 9/1950 | Foster | 229/117.14 X |
| 2,841,279 | 7/1958 | Forrer | 229/117.14 X |
| 3,825,171 | 7/1974 | Dewhurst | 229/117.09 X |
| 4,171,763 | 10/1979 | Card | 229/148 X |
| 4,482,090 | 11/1984 | Milliens | 229/117.13 X |
| 4,516,718 | 5/1985 | Forbes, Jr. | 229/148 X |
| 4,535,929 | 8/1985 | Sherman, II et al. | 229/39 R |
| 4,651,919 | 3/1987 | Mischusen, III | 229/117.14 X |

*Primary Examiner*—Gary E. Elkins
*Assistant Examiner*—Tri M. Mai
*Attorney, Agent, or Firm*—Sprung Kramer Schaefer & Briscoe

[57] ABSTRACT

A reclosable, cuboidal folding box, which can be manually assembled, having a single closure flap which comprises a double-walled hanging tab with hanging means and separate tabs to stabilize the box, and form a tamperproof closure.

11 Claims, 5 Drawing Sheets

MANUAL ASSEMBLY FOLDING BOX WITH TAMPERPROOF CLOSURE

DESCRIPTION

Figure 1:
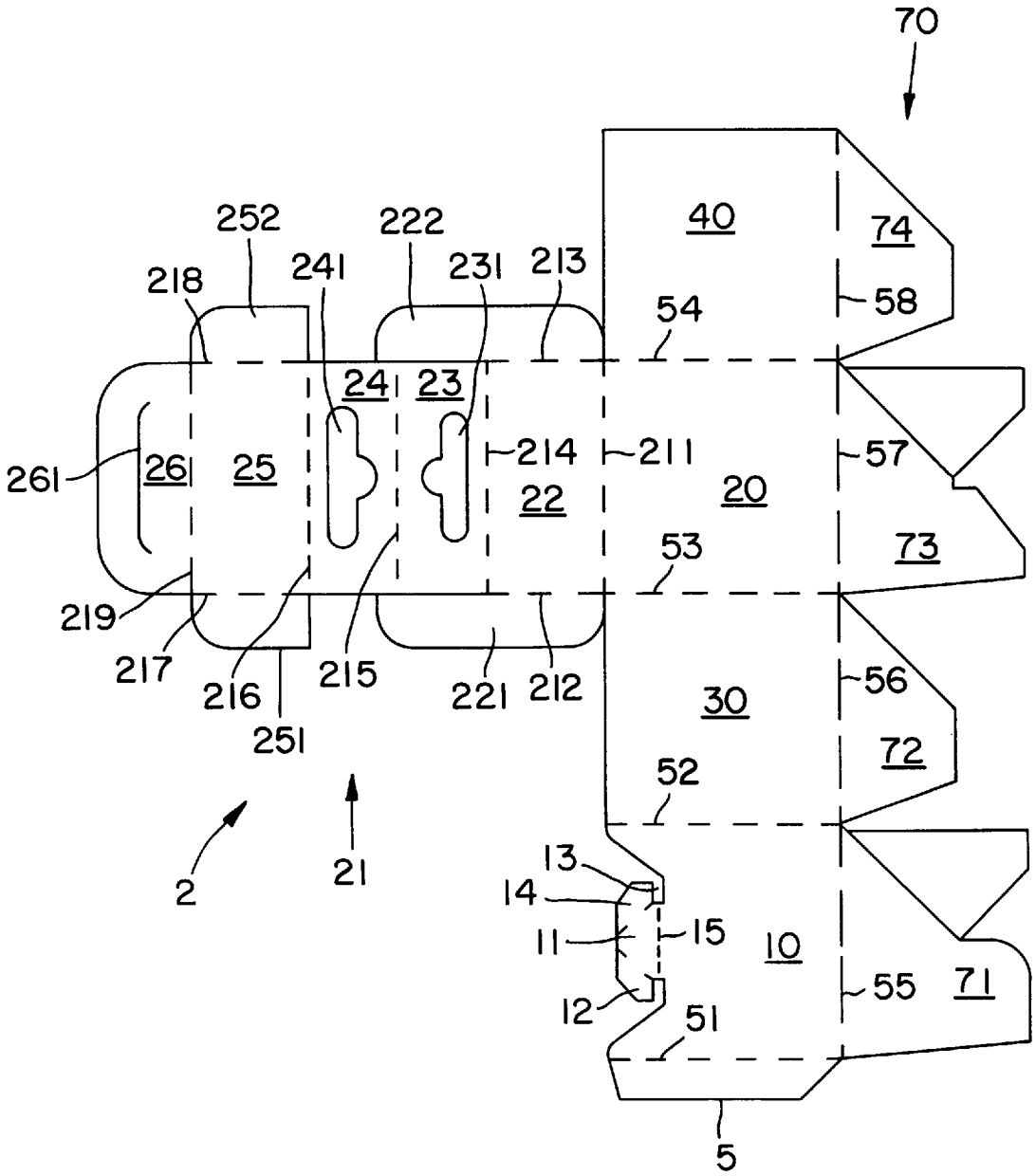

The invention relates to a reclosable, cuboidal folding box with a front side wall, a rear side wall, a right-hand side wall connecting the front side wall and the rear side wall, a left-hand side wall, a base closure, and a closure flap which closes the box and, at the same time, makes it possible for the folding box to be hung on the known hooks in the self-service racks in shops and pharmacies.

German Patent Application DE 39 32 441 discloses a reclosable folding box which comprises a front side wall and a rear side wall, two side walls which connect the front side wall and the rear side wall, a base part and a top closure flap, the closure flap being connected, via a fastening tab, to an insertion tongue which, for its part, is arranged in the rear side wall or front side wall via a weakened line and can be torn out of said wall. Nevertheless, this folding box does not provide any way of hanging it on a hook.

Once this folding box has been filled with the goods for sale, it has to be displayed to the customer in a manner which is both attractive and allows the box to be handled as easily as possible. A very clear display method is made possible by the generally known sales-rack self-service hooks which receive a number of folding boxes arranged one behind the other.

So that the abovedescribed folding box can be hung on such a hook, a correspondingly formed blank with a hanging means must additionally be provided on the folding box. This usually takes place by this part with the corresponding hanging means being adhesively bonded on the folding box, at a suitable location thereof, in an additional operation. However, this complicates the process for producing the folding box, inter alia as a result of the production of the further blank or the adhesive bonding of the same on the finished box, and lengthens the time taken for this process by a number of steps; furthermore, there is a very much-higher outlay in terms of equipment.

German Patent Application DE 43 22 555 likewise discloses a reclosable, cuboidal folding box. This folding box comprises a rear side wall, which is formed from an outer side-wall part and an inner side-wall part, a front side wall, two side walls connecting the front side wall and the rear side wall, a base closure and a top closure, the top region of the outer side-wall part having a hanging tab with a correspondingly formed hanging means, for example a round hole or slit.

The hanging tab can be used to place the folding box on a hook. However, since the hanging tab is only of a single-layer design and consists of the same material as the rest of the folding box, a number of problems arise when the folding box is used in practice.

If, taking environmental and cost aspects into account, the folding box is produced from thin material, the hanging tab has insufficient stability. Even if there is a slight, unintentional pull on the folding box, the hanging tab comes away, with the result that the latter loses its function and it is no longer possible for the box to be hung up as desired. Furthermore, the box becomes unsightly and cannot be displayed to the customer any longer.

On the other hand, although producing the folding box from thicker, more stable material results in it being possible for the hanging tab to be subjected to tensile forces to a far greater degree, it is also the case, at the same time, that an unnecessarily large amount of material is wasted because the rest of the walls of the folding box are designed to be over-dimensioned.

Furthermore, the box always has to be opened at the base. Should the folding box be closed incorrectly and if said box is then hung on a hook again, the situation where the contents drop out of the folding box cannot be ruled out. For reasons of hygiene, this state of affairs is not acceptable, in particular when the folding box is filled with plasters.

German Utility Model DE G 90 06 652 discloses a closure flap on an otherwise conventional pack, said closure flap being formed from four individual constituent parts, that is to say a first wall, two hanging tabs and a second wall. Nevertheless, there are no laterally articulated tabs at all on the walls. Furthermore, reversible closure of the box is not possible.

U.S. Pat. No. 4,344,533 describes a pack which has a body formed from four walls and also has a closure flap which is articulated on the lateral edge of the rear side wall of the pack. The closure flap comprises a first wall, which is articulated on the lateral edge of the rear side wall, two tabs being articulated on the narrow sides of the first wall, a first hanging tab, which has a hanging means and is articulated on the first wall via a folding line, a second hanging tab, which has a hanging means and is articulated on the first hanging tab via a folding line, a second wall, which is articulated on the second hanging tab, and an end tab, which is articulated on the second wall, a tab being articulated on one of the narrow sides of the end tab.

European Patent Application EP 0 586 984 discloses a pack which has a closure which is formed by just one closure flap. This closure flap essentially comprises two hanging tabs, two lugs being articulated on the first of these hanging tabs, and a second wall.

The lugs articulated on the hanging tab serve merely as reinforcement for the hanging device.

The object of the invention is to provide a reclosable, cuboidal folding box which has a double-layer hanging device, to be precise, using the smallest possible amount of material but providing for high stability, which can always be opened from the top, can be produced cost-effectively as a whole, using the smallest possible amount of material, can be easily and quickly assembled, filled and closed by hand, and the folding blank of which, together with the integrated hanging device, comprises a single piece.

This object is achieved by a reclosable, cuboidal folding box as is explained in more detail in claim 1. Advantageous configurations are explained in the sub-claims.

Accordingly, the reclosable, cuboidal folding box has a front side wall, a rear side wall, a right-hand side wall connecting the front side wall and the rear side wall, and a left-hand side wall, these walls together forming the body of the assembled folding box.

At the base, the folding box may be closed fixedly, but it may well have a reclosable closure depending on the particular application case. A base closure made of an adhesively bonded folding-base closure, comprising four base tabs, has turned out to be particularly advantageous. These four base tabs are formed in accordance with the ECMA code A 510, or the new ECMA code A 6020, and are also adhesively bonded accordingly, this resulting in a stable closure which can only be opened by force.

A closure flap is articulated, by means of a folding line, on the rear side wall, at the edge located opposite the base. This closure flap comprises a series of a number of individual parts, which are each linked to one another via folding lines.

First of all, a first wall is articulated on the rear side wall, two tabs being articulated on the narrow sides of the first wall. The first wall is adjoined by a first hanging tab with a hanging means, for example a slit or round hole, and then a second hanging tab with a hanging means. This is followed by a second wall, two tabs being articulated on the narrow sides thereof.

The first hanging tab and the second hanging tab are advantageously of congruent form, and furthermore the first wall and the second wall are of the same width. As a result, when the folding box is in a finished state, the hanging device is located precisely in the centre of the top closure.

The closure flap is terminated by an end tab.

In an advantageous embodiment, an insertion tongue is integrated in the front side wall of the reclosable, cuboidal folding box, to be precise on that edge of the front side wall which is located opposite the base closure. This insertion tongue is fastened on the front side wall by means of a perforation line, with the result that the insertion tongue can be easily removed from the folding box. At the same time, this perforation line may be located centrally in a neck-like constriction.

The insertion tongue engages into the end tab of the closure flap via an insertion slit, thus forming the reclosable lid closure of the folding box.

Preferably, either the tabs on the first wall or the tabs on the second wall are of a length which corresponds to the sum of the widths of the first and second walls.

With the folding box in the finish-bonded state, the first hanging tab and the second hanging tab may be adhesively bonded to one another; furthermore in each case one tab of the first wall of the closure flap and one tab of the second wall of the closure flap may be adhesively bonded to one another.

The invention also relates to the punched blank for producing a folding box characterized in the claims.

The punched blank for producing a reclosable, cuboidal folding box having a front side wall, a rear side wall, a right-hand side wall connecting the front side wall and the rear side wall, a left-hand side wall and a base closure consists of paperboard, cardboard or another suitable material.

The rear side wall, the right-hand side wall connecting the front side wall and the rear side wall, the front side wall, the left-hand side wall and a tab are each linked to one another via folding lines and arranged in a rectilinear manner in a row one behind the other.

A closure flap is articulated, by means of a folding line, on the rear side wall, at the edge located opposite the base, and is made up of the constituent parts explained above.

An insertion tongue is integrated in the front side wall and is retained in the front side wall via a perforation line, and an insertion slit is provided in the end tab.

Finally, a base closure flap is respectively articulated, via a folding line, on the front side wall, the right-hand side wall, the rear side wall and the left-hand side wall.

The folding box according to the invention fulfils the requirements set within the object of the invention as a result of the special configuration of the top closure flap and, in an advantageous embodiment, as a result of the insertion tongue integrated in the front side wall.

Adhesive bonding of the flat punched blank of the folding box forms a hanging device on the folding box, said hanging device being made up of two hanging tabs—and therefore of two layers of material. This gives the advantage of the hanging device being characterized by high stability, with the result that it withstands even relatively high tensile stressing without there being any risk of tearing. In particular, adhesive bonding of the two hanging tabs to one another results in a fixed arrangement, which may also be configured in a visually pleasing manner. Furthermore, the hanging device may be arranged centrally, with the result that the box hangs straight, which is to be preferred from the visual point of view.

Apart from the hanging device, the rest of the walls of the folding box, with the exception of adhesive-bonding locations provided, are each of a single-layer design. This means that, overall, only a very small amount of material is used to form the folding box, a hanging device which can be subjected to stressing nevertheless being formed.

Integrating the hanging device in the folding blank of the folding box makes it possible for all the adhesive bonding of the folding box to be carried out within one step. This dispenses with a subsequent, and thus unnecessarily laborious, operation of adhesively bonding a hanging device on the otherwise finished box.

The hanging device, formed from the hanging tabs, may be of a very small configuration, with the result that the folding box can be hung in a rack in an extremely space-saving manner.

In particular designing the folding box with the insertion tongue makes it possible for the folding box, as is usually preferred, to be opened, and also closed again, at the top. This largely rules out the undesirable occurrence of the contents dropping out. Furthermore, the insertion tongue, which can easily be removed via a perforation line, constitutes a tamperproof closure.

The folding box is designed as a manual-assembly pack. This pack is made by adhesively bonding and assembling the punched blank, filling with the desired product in a correspondingly designed filling station, and adhesively bonding the top closure in accordance with the method explained hereinbelow. This produces a reclosable pack which protects the products located in the interior of the folding box against dust.

Figure 2:
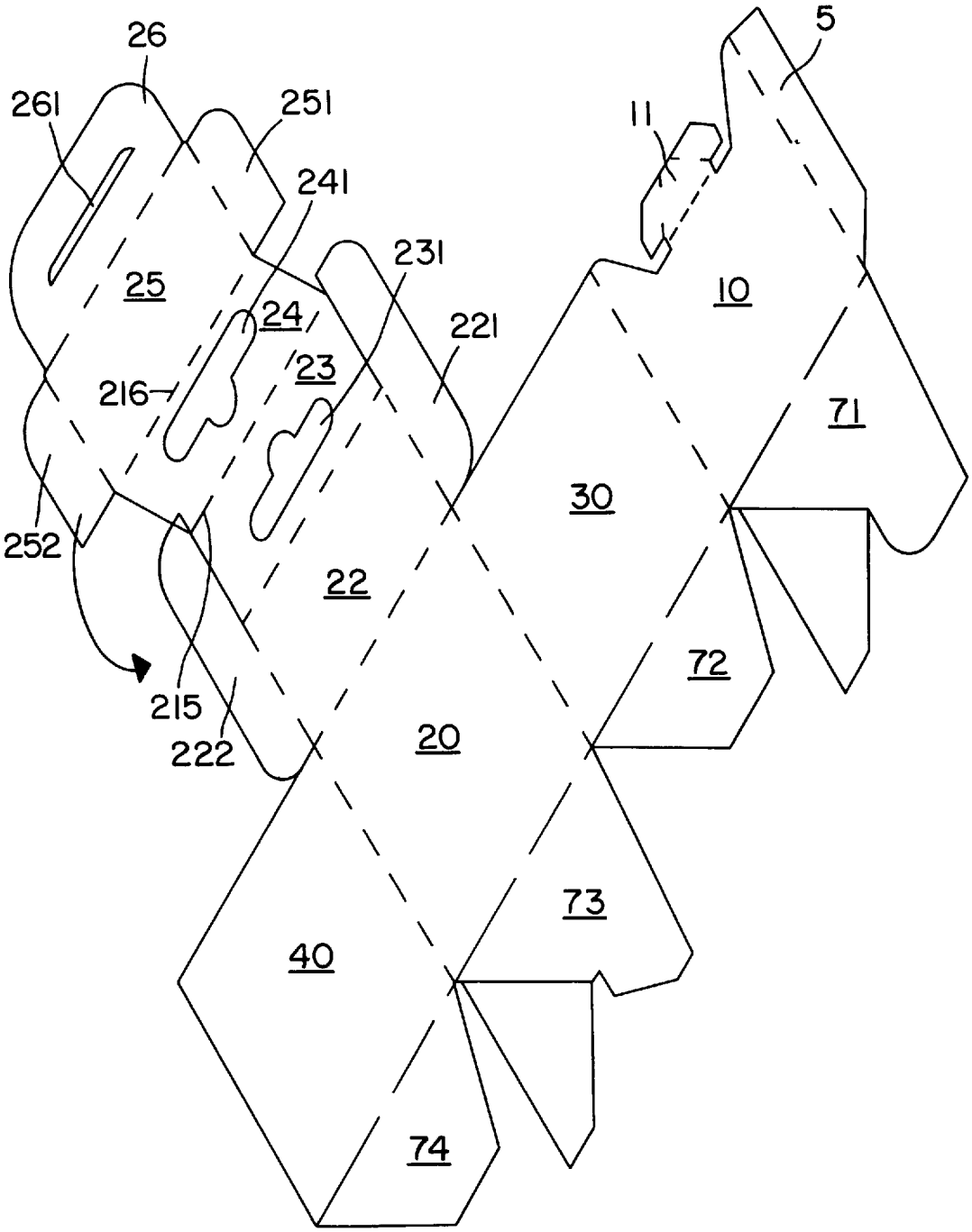
Figure 3:
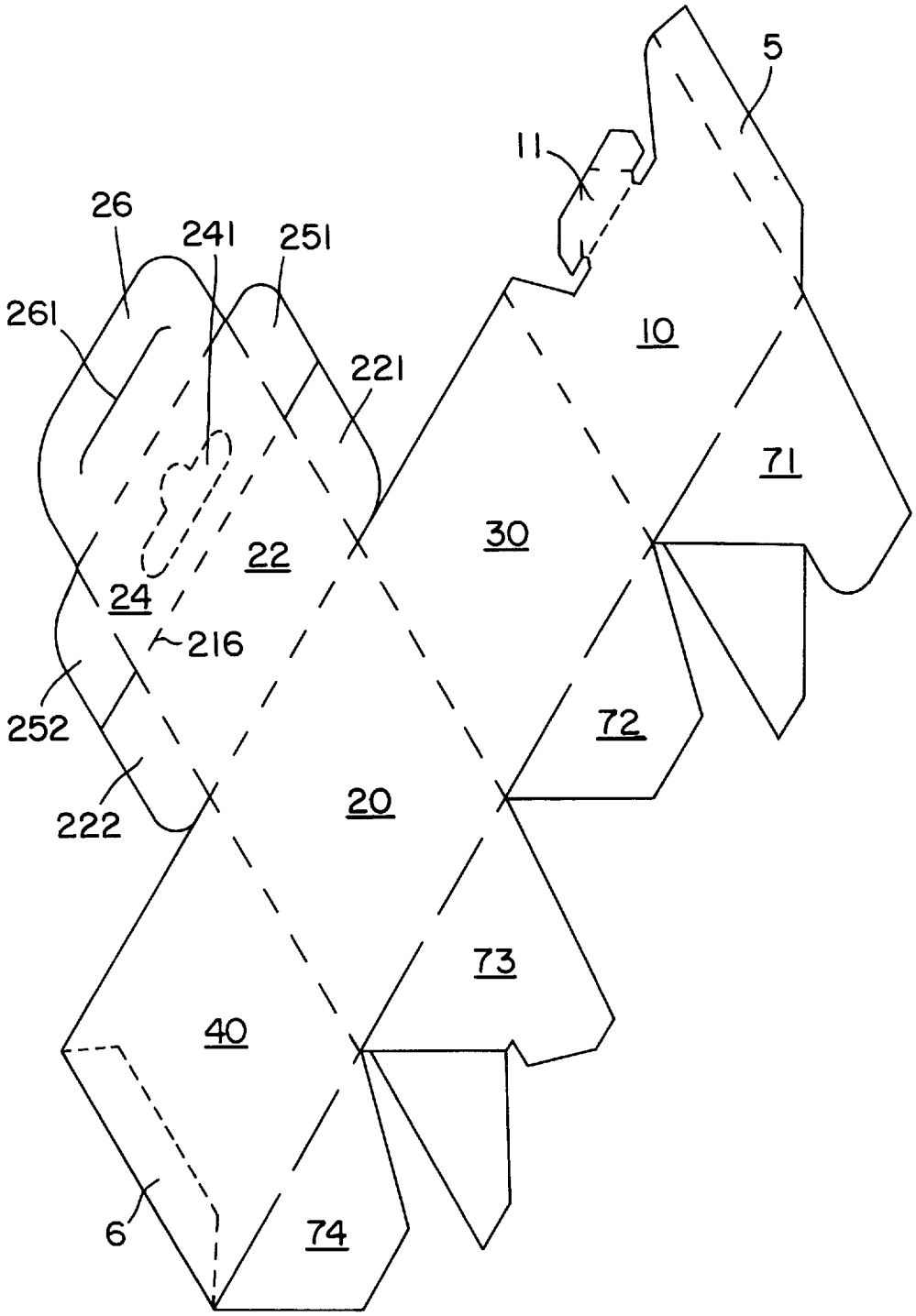
Figure 4:
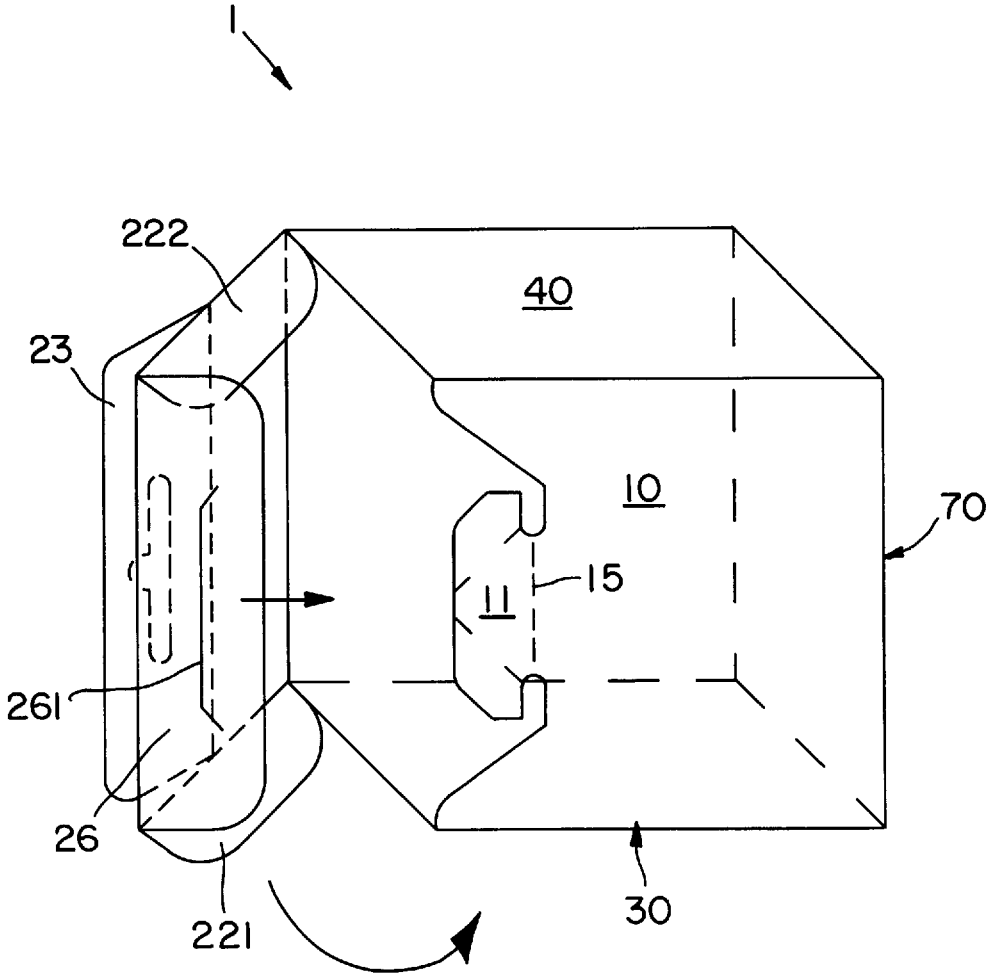
Figure 5:
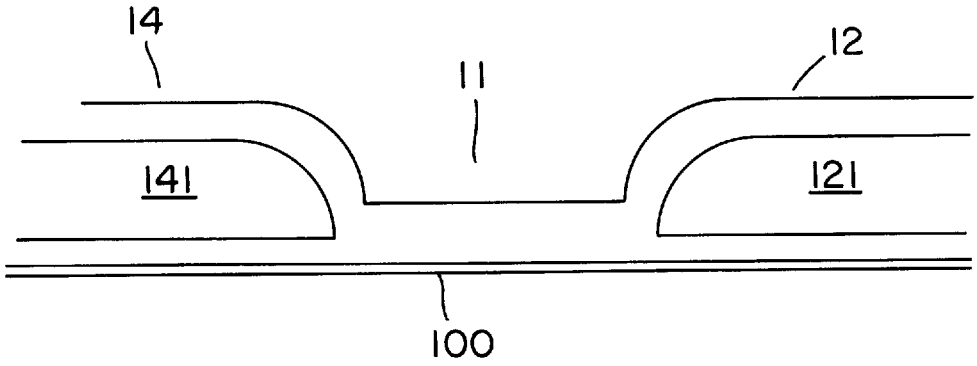
Figure 6:
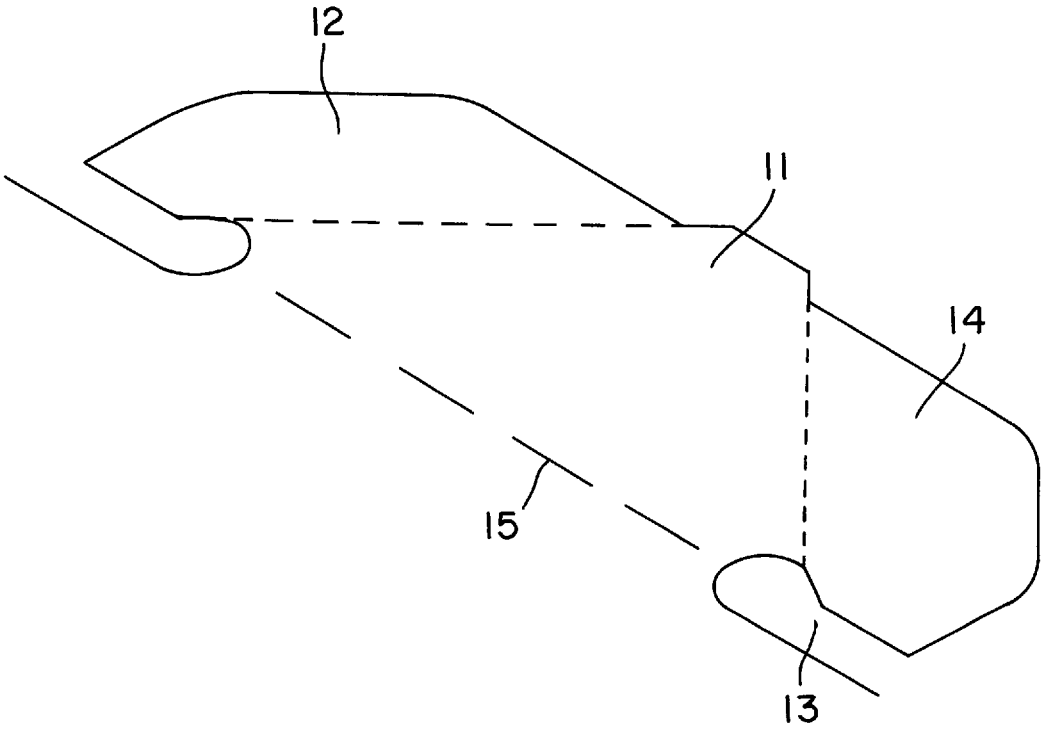

A particularly advantageous design of the folding box and punched blank, and the method of adhesively bonding the particularly advantageous folding box, are explained in more detail, without thereby wishing to restrict the invention unnecessarily, with reference to the figures, which are described hereinbelow and in which:

FIG. 1 shows the flat, non-bonded punched blank of the particularly advantageously designed folding box, FIGS. 2 to 4 show the operation of adhesively bonding the folding box, FIG. 5 shows the operation of underlaying the insertion tongue in the punching tool, and FIG. 6 shows the insertion tongue.

FIG. 1 illustrates the folding blank 2 of the folding box 1. The folding blank 2 may consist of paperboard, cardboard or another suitable material. The body of the assembled folding box 1 is formed by the front side wall 10, the rear side wall 20, the right-hand side wall 30 connecting the front side wall 10 and the rear side wall 20, and the left-hand side wall 40, a tab 5 being articulated laterally on the front side wall 10 for the purpose of the non-releasable closure of the body, and being adhesively bonded to the left-hand side wall 40.

All the sides walls 10, 20, 30, 40 are rectangular, although the front side wall 10 and the rear side wall 20, which are preferably of the same dimensions, are somewhat wider than the other two side walls 30, 40, which likewise are preferably of identical dimensions. The tab 5 is shaped so as to taper in a slightly trapezoidal manner in the direction of its free end and, on the one hand, is wide enough to permit reliable adhesive bonding to the left-hand side wall 40 and, on the other hand, is, at most, as wide as the two side walls 30, 40.

The individual side walls 10, 20, 30, 40 and the tab 5 are connected to one another via corresponding folding lines 51, 52, 53, 54.

The closure flap 21 is articulated on the rear wall 20 at the folding line 211, which is located opposite the base closure 70. The closure flap 21 essentially comprises five individual sections, which are each connected to one another via a folding line 214, 215, 216, 219.

The rear wall 20 is adjoined first of all by the rectangular, first wall 22. The first hanging tab 23, which is articulated on said first wall 22, and the second hanging tab 24 are likewise rectangular and, furthermore, are also of congruent form. A hanging means 231, 241 is provided in each case in the two hanging tabs 23, 24. The hanging means 231, 241 are in the form of a slit and round hole, the hanging means 241 in the second hanging tab 24 being of somewhat larger dimensions than the hanging means 231 in the first hanging tab 23, in order to be able to compensate for unavoidable inaccuracies during the adhesive bonding of the closure flap 21. The second hanging tab 24 is followed by the second wall 25, which is likewise rectangular and, furthermore, is of identical dimensions to the first wall 22. The termination is formed by the end tab 26, which has an insertion slit 261, the significance of which will be discussed at a later stage in the text.

The first wall 22 is provided laterally—that is to say on the narrow sides—with two tabs 221, 222, via a folding line 212, 213 in each case, and the second wall 25 is likewise provided with two tabs 251, 252 via the folding lines 217, 218. The length of the tabs 221, 222 respectively corresponds to the width of the right-hand side wall 30 and of the left-hand side wall 40. The width of the tabs 221, 222 is selected such that dust is reliably prevented from penetrating into the finish-bonded and closed folding box 1. The free corners of the tabs 221, 222 are rounded, in order to make it easier to handle the closure formed from the closure flap 21. The tabs 251, 252 on the second wall 25 are as long as the second wall 25 is wide; furthermore, the tabs 251, 252 are of the same width as the tabs 221, 222 on the first wall 22. For functional reasons, only two corners on the tabs 251, 252 are rounded.

In order to allow the reversible closure of the folding box 1, an insertion tongue 11 is integrated in the front side wall 10, said tongue being punched directly out of the material of the front side wall 10. The insertion tongue 11 is connected to the front side wall 10 via a perforation line 15, which can be easily severed. In order to make it easier to sever the perforation line 15, the latter is located, between the insertion tongue 11 and front side wall 10, centrally in a neck-like constriction 13, as a result of which the perforation line 15 is of a smaller length than the base of the insertion tongue 11. The insertion tongue 11 has two folded tabs 12, 14 on the sides.

Upon closure of the folding box 1, the insertion tongue 11 engages in the insertion slit 261 of the end tab 26. In this case, the free ends of the insertion tongue 11 interlock with the insertion slit 261, with the result that it is only possible to open the folding box 1 by severing the perforation line 15. A tamperproof closure is thus produced.

The insertion slit 261 preferably has a punched-out section, in order to make it easier to introduce the insertion tongue 11.

Finally, a base tab 71, 72, 73, 74 is respectively articulated, via folding lines 55, 56, 57, 58, on the side walls 10, 20, 30, 40. These base tabs 71, 72, 73, 74 form a base closure 70, which, according to ECMA code A 50, is designated as an adhesively bonded folding-base closure. The special shaping of the base tabs 71, 72, 73, 74 causes this base closure 70 to assemble automatically during the adhesive bonding of the folding box 1. It is not possible for the base closure 70 to be opened from the outside when the folding box 1 is filled with contents.

FIG. 2 illustrates the first step of the adhesive bonding of the folding box 1, and, for the sake of clarity, as is also the case in the following figures, not all the folding lines have been numbered, especially since they are designated to a sufficient extent in FIG. 1. Taking the flat punched blank 2 of the folding box 1 as a basis, first of all the second hanging tab 24 is bent over, through 180° in all, at the folding line 215. At the same time, during the operation of folding over the second hanging tab 24, the second wall 25 and the end tab 26 continue to be aligned parallel to the punched blank 1, by way of the folding line 216.

According to FIG. 3, after being rotated through 180°, the second hanging tab 24 is laid flatly on the first hanging tab 23, and, at the same time, for the sake of stability, the two hanging tabs 23, 24 are adhesively bonded. In parallel, the tabs 251, 252 of the second wall 25 are folded flatly on the tabs 221, 222 of the first wall, these tabs 221, 222, 251, 252 also being adhesively bonded to one another in each case. This produces an extremely stable hanging device on the folding box 1.

Marked on the left-hand side wall 40 is the region 6, on which the tab 5 is adhesively bonded in order to form the stable body of the folding box 1.

Finally, FIG. 4 shows the virtually finish-bonded folding box 1. The body has been folded and, furthermore, the base closure 70 has been closed by appropriate adhesive bonding and interconnection of the respective base tabs 71, 72, 73, 74. Finally, the folding box 1 is closed by the end tab 26 with the insertion slit 261 being advanced up to the insertion tongue 11. The insertion tongue 11 engages in the insertion slit 261 such that the free ends on the insertion tongue 11 interlock with the insertion slit 261. As a result, it is only possible to open the folding box 1 if the insertion tongue 11 is severed at the perforation line 15. This produces the tamperproof closure of the folding box 1.

In parallel, the tabs 221, 222 are guided into the body of the folding box 1, this reliably preventing dirt or dust from penetrating into the folding box 1.

Finally, the hanging devices, formed from the two hanging tabs 23, 24, can be rendered upright, with the result that the hanging device projects at right angles.

FIG. 5 shows the operation of underlaying the insertion tongue 11. In this case, in the punching tool 15, the tabs 12, 14 of the insertion tongue 11 are underlaid with plastic sections 121, 141, or sections made of a similar material, during the operation of punching the blank of the folding box 1.

FIG. 6 represents the insertion tongue 11. The tabs 12, 14 underlaid by the plastic sections 121, 141 are angled slightly so as to enhance the interlocking of the tabs 12, 14 with the insertion slit 261 in the end tab 26, in particular when the insertion slit 261 comprises an incision which is angled correspondingly at its edges.

We claim:

1. Reclosable, cuboidal folding box having a front side wall, a rear side wall, a right-hand side wall connecting the front side wall and the rear side wall, a left-hand side wall, and a base closure, wherein a closure flap (21) is articulated, by means of a folding line (211), on the rear side wall, (20), at the edge located opposite the base closure (70), said closure flap comprising a) a first wall (22), two tabs (221), (222) being articulated on the narrow sides of the first wall (22), b) a first hanging tab (23), which has a hanging means (231) and is articulated on the first wall (22) via a folding line (214), c) a second hanging tab (24), which has a hanging means (241) and is articulated on the first hanging tab (23) via a folding line (215), d) a second wall (25), which is articulated on the second hanging tab (24) via a folding line (216), two tabs (251), (252) being articulated on the narrow sides of the second wall (25), and e) an end tab (26), which is articulated on the second wall (25) via a folding line (219), said tabs (221, 222, 251, 252) being folded downwardly and engaging said side walls to stabilize said box.

2. Reclosable, cuboidal folding box according to claim 1, wherein an insertion tongue (11) is integrated on that edge of the front side wall (10) which is located opposite the base closure (70), and an insertion slit (261) is provided in the end tab (26) of the closure flap (21).

3. Reclosable, cuboidal folding box according to claim 2, wherein the insertion tongue (11) is fastened in the front side wall (10) by a perforation line (15).

4. Reclosable, cuboidal folding box according to claim 3, wherein the perforation line (15), between the insertion tongue (11) and front side wall (10), is located centrally in a neck-like constriction (13).

5. Reclosable, cuboidal folding box according to claim 1, wherein the first wall (22) and the second wall (25) are of the same width.

6. Reclosable, cuboidal folding box according to claim 1, wherein the first hanging tab (23) and the second hanging tab (24) are of congruent form.

7. Reclosable, cuboidal folding box according to claim 1, wherein the length of the tabs (251), (252) on the second wall (25) corresponds to the sum of the width of the first wall (22) and the second wall (25).

8. Reclosable, cuboidal folding box according to claim 1, wherein, with the folding box 1 in the finish-bonded state, the first hanging tab (23) and the second hanging tab (24) are adhesively bonded to one another.

9. Reclosable, cuboidal folding box according to claim 1, wherein, with the folding box 1 in the finish-bonded state, in each case one tab (221), (222) of the first wall (22) of the closure flap (21) and one tab (251), (252) of the second wall (25) of the closure flap (21) are adhesively bonded to one another.

10. Reclosable, cuboidal folding box according to claim 1, wherein the base closure (70) is formed from an adhesively bonded folding-base closure comprising four base tabs (71), (72), (73), (74).

11. Punched blank for producing a reclosable, cuboidal folding box having a front side wall, a rear side wall, a right-hand side wall connecting the front side wall and the rear side wall, a left-hand side wall, and a base closure, wherein the folding box 1 comprises a folding blank (2) made of paperboard or cardboard, the rear side wall (20), the right-hand side wall (30) connecting the front side wall (10) and the rear side wall (20), the front side wall (10), the left-hand side wall (40) and a tab (5) each being linked to one another via folding lines (51), (52), (53), (54) and arranged in a rectilinear manner in a row one behind the other, a closure flap (21) being articulated, by means of a folding line (211), on the rear side wall (20), at the edge located opposite the base closure (70), said closure flap comprising a) a first wall (22), two tabs (221), (222) being articulated on the narrow sides of the first wall (22), b) a first hanging tab (23), which has a hanging means (231) and is articulated on the first wall (22) via a folding line (214), c) a second hanging tab (24), which has a hanging means (241) and is articulated on the first hanging tab (23) via a folding line (215), d) a second wall (25), which is articulated on the second hanging tab (24) via a folding line (216), two tabs (251), (252) being articulated on the narrow sides of the second wall (25), and e) an end tab (26), which is articulated on the second wall (25) via a folding line (219), an insertion tongue (11) being integrated in the front side wall (10) and being retained in the front side wall (10) via a perforation line (15), and an insertion slit (261) being provided in the end tab (26), a base closure tab (71), (72), (73), (74) being respectively articulated, via a folding line (55), (56), (57), (58), on the front side wall (10), the right-hand side wall (30), the rear side wall (20) and the left-hand side wall (40).

* * * * *